United States Patent [19]

Burke

[11] Patent Number: 4,566,474

[45] Date of Patent: Jan. 28, 1986

[54] CRUTCH

[76] Inventor: Edmund T. Burke, R.R. #2, Kilworthy, Ontario, Canada, POEIGO

[21] Appl. No.: 600,137

[22] Filed: Apr. 13, 1984

[51] Int. Cl.[4] ..... A61H 3/02

[52] U.S. Cl. ..... 135/69

[58] Field of Search ..... 135/68, 69, 75

[56] References Cited

U.S. PATENT DOCUMENTS

| | | | |
|---|---|---|---|
| 79,305 | 6/1868 | Bowen | 135/69 |
| 596,203 | 12/1897 | Drake | 135/69 |
| 705,741 | 7/1902 | Drew | 135/69 |
| 909,224 | 1/1909 | Rhodes | 135/69 |
| 987,497 | 3/1911 | Shadell et al. | 135/69 |
| 1,225,364 | 5/1917 | Sanders | 135/69 |
| 1,262,153 | 4/1918 | Wolf | 135/69 |
| 1,499,458 | 7/1924 | Hughes | 135/69 |
| 1,501,580 | 7/1924 | Beam | 135/69 |
| 2,585,730 | 2/1952 | Bodnar | 135/68 |
| 3,858,596 | 1/1975 | Thomas | 135/69 |
| 4,476,885 | 10/1984 | Stein | 135/69 |

FOREIGN PATENT DOCUMENTS

| | | | |
|---|---|---|---|
| 332343 | 1/1921 | Fed. Rep. of Germany | 135/69 |
| 1456852 | 9/1966 | France | 135/68 |

*Primary Examiner*—Robert A. Hafer
*Assistant Examiner*—Arnold W. Kramer

[57] ABSTRACT

An improved adjustable convalescent crutch is provided comprising a top pair of spaced vertically extending support members, each support member carrying a plurality of apertures therethrough, telescopical with respect to a bottom portion of the crutch having a pair of vertically extending support members, spaced apart at the top of the bottom portion, each support member carrying a plurality of apertures therethrough, and converging together towards the bottom to be affixedly joined together in a "Y-shaped" configuration whereby only one of the support members continues down to form the foot of the crutch of the same diameter and material as the one support member, comprising the bottom of the "Y-shaped" configuration. A handgrip is provided having a longitudinal hole therethrough for co-operating with the apertures through the support members, whereby the height of the crutch and the position of the handle may be adjusted in a single adjustment of affixedly joining the handgrip between the pair of telescoped support members by a carriage bolt and wing nut.

1 Claim, 6 Drawing Figures

CRUTCH

FIELD OF INVENTION

This invention relates to an improved adjustable convalescent crutch.

BACKGROUND OF INVENTION

Crutches constructed of either wood or metal and used throughout the world are commonly of a wishbone shape providing a pair of spaced vertically extending support members gradually converging to a single support leg which extends to the ground. The upper end of the pair of vertically extending support members is spaced by a horizontally extending underarm rest and carries a handgrip therebetween intermediate the underarm rest and support leg. To maximize the number of people to whom the crutch can be fitted, adjustment has been provided. However, the adjustment provided requires two separate adjustments, one to adjust the overall length of the crutch and the other to adjust by a separate adjustment, the position of the handgrip provided within the wishbone shape to permit the horizontal underarm rest to seat under the underarm of the person and permit the person's arm to comfortably hold the handgrip. While adjustment has been provided, this adjustment requires two separate adjustments and therefore is inconvenient. Further, because the adjustment of the overall length of the crutch requires extending the single support leg, the extension of the single support leg, while still achieving structural integrity in the crutch, is limited. As a result, up to three sizes of crutches are needed to fit all members of society comprising 36–42 inches, 42–50 inches, and 48–60 inches.

It is therefore an object of this invention to provide an improved adjustable crutch which overcomes the deficiences of the prior art. Further and other objects of the invention will be realized by those skilled in the art from the following summary of the invention and detailed description of a preferred embodiment thereof.

SUMMARY OF THE INVENTION

According to one aspect of the invention, an adjustable crutch carrying a horizontally extending underarm rest at the top thereof and generally of the wishbone shape is provided comprising a pair of vertically adjustable supports adjustable with respect to one another to permit the length of the crutch from the underarm rest to the bottom of the crutch to be adjusted and a handgrip adjustably positionable with respect to the supports carried by the supports to permit adjustment of the distance between the underarm rest and handgrip and a single fastening means for securing the pair of vertically adjustable supports and position the handgrip at the same time.

According to another aspect of the invention, an improved adjustable crutch of the wishbone shape is provided comprising (a) an upper pair of spaced vertically extending support members, each support member having two ends, an upper and lower end, said upper pair of spaced support members being spaced from each other at their upper end by a horizontally extending underarm rest, the lower ends of each support member being spaced from the lower end of the other support member, the upper pair of spaced support members, each carrying a plurality of apertures therethrough, preferably proximate the lower end, aligned with the apertures in the other support member; (b) a lower pair of spaced vertically extending support members, each support member having an upper end spaced from the upper end of the other support member and converging to a single support leg, the lower pair of support members each carrying a plurality of apertures therethrough aligned with the apertures of the other support member; (c) the lower ends of the upper pair of support members and the upper ends of the lower pair of support members being telescopical one into the other (preferably being frictionally telescopically inserted and held with respect to one another when they are telescoped one into the other), for aligning apertures in each of the support members of the upper pair of support members with apertures of each of the support members of the lower pair of support members; (d) a rod extending between the telescoping members and through the aligned apertures for securing the pairs of upper and lower support members together, the rod carrying a handgrip thereon between the support members; (e) a handgrip carried on the rod; and (f) fastening means for securing the rod to the support members.

In another of its aspects, the invention provides an adjustable crutch comprising:

(a) an upper pair of spaced vertical supports, each support having two ends, an upper and lower end, said supports spaced from each other at an upper end by a horizontally extending underarm rest;

(b) a lower pair of spaced vertically extending supports comprising a pair of spaced sleeves at their upper end, each sleeve of just sufficient diameter to accomodate one of the lower ends of the upper supports, the lower ends of the lower pair of vertically extending supports converging to a single leg;

(c) the upper pair of spaced vertically extending supports for sliding within the sleeves of the lower pair of supports but being frictionally supported within the lower supports;

(d) a plurality of locking holes provided through the supports and sleeves and aligned with one another to permit a rod to pass therethrough, the rod carrying a handgrip between the supports and sleeves;

(e) fastening means for securing the rod through the locking holes.

For single action adjustment of each crutch the upper and lower supports are appropriately moved with respect to one another to adjust the vertical extent of the crutch to provide a crutch length equal to the distance between the floor and the underarm of the patient, and the handgrip appropriately positioned with respect to the length of the extended arm of the convalescing patient and both are secured by one fastener.

Preferably, the rod consists of a carriage bolt and a wing nut is threaded on the end to prevent lateral movement of the carriage bolt.

In another of its aspects, the upper pair of supports comprises vertically extending sleeves which receive the lower pair of supports.

According to another aspect of the invention, the upper pair of support members may comprise solid extrusions or hollow tubes.

According to another aspect of the invention, the upper pair and lower pair of vertical support members which overlap (for example telescopical with respect to one another) are adjustable with respect to one another, the adjustment selected from the following adjustments permitting two standard sizes of crutches to fit all members of society with crutch sizes 36–48 inches and 48–60 inches while achieving structural integrity of the crutch. Preferably, not more than twelve vertically spaced aligned apertures are provided to ensure that a sufficient segment of the upper and lower vertical support members telescopically overlap sufficiently to preserve the structural integrity of the crutch. It will be appreciated that the availability of two rather than three standard sizes of crutches to fit all members of society is advantageous.

The invention will now be illustrated with reference to drawings of an embodiment of the invention.

DESCRIPTION OF EMBODIMENT OF THE INVENTION

Figure 1:
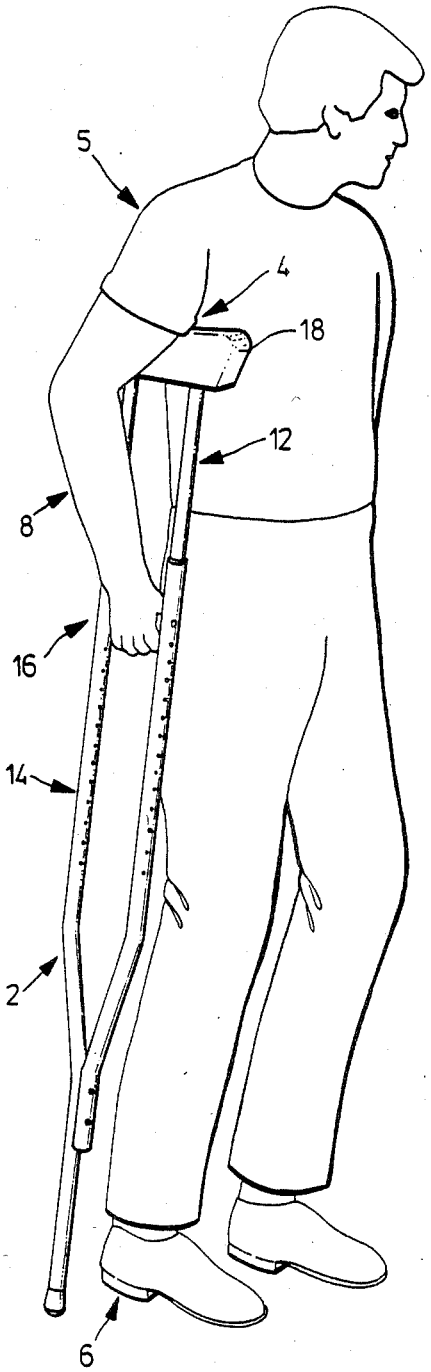
FIG. 1 is a perspective view depicting an adjustable crutch adjusted to fit a relatively tall person according to an embodiment of the invention.
Figure 2:
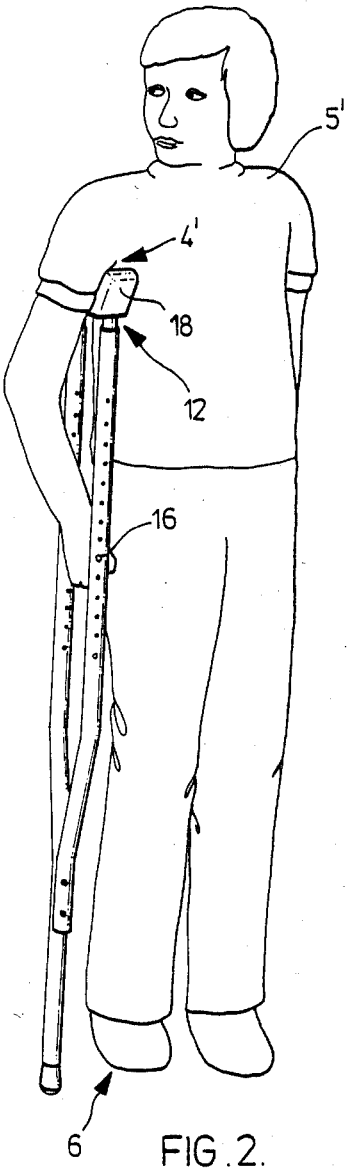
FIG. 2 is a perspective view depicting the adjustable crutch of FIG. 1 adjusted to fit a relatively short person.
Figure 3:
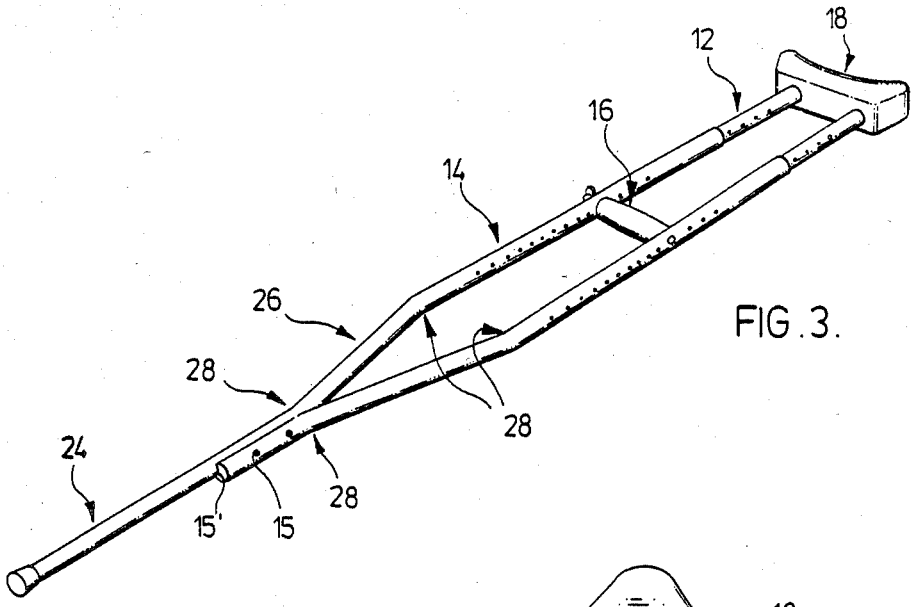
FIG. 3 is a side perspective view of the crutch shown in FIG. 1.
Figure 4:
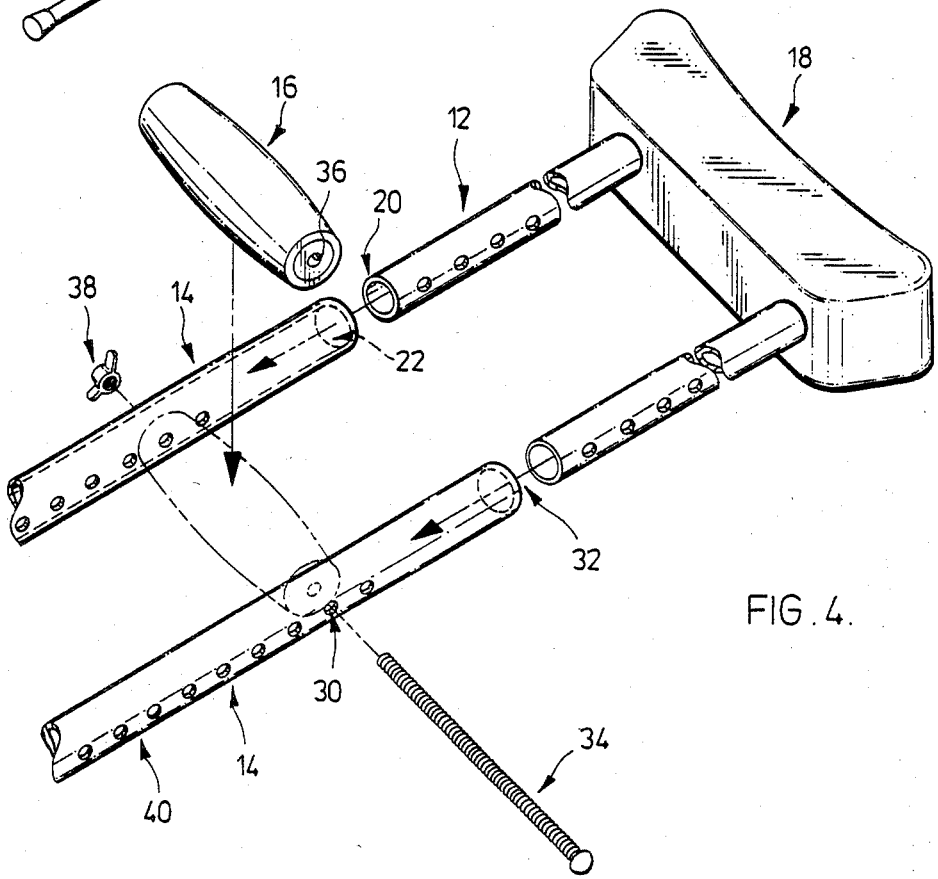
FIG. 4 is a perspective close-up partially exploded view of a portion of the crutch shown in FIGS. 1, 2 and 3.

With reference to FIGS. 1, 2 and 3, adjustable crutch 2 is shown used for assisting the support of two people—one tall and one short. Crutch 2 is adjustable to provide a crutch of varying lengths from the underarm 4 of man 5 to the ground 6 (See FIG. 1) and from the other underarm 4' to the ground 6 of person 5' (See FIG. 2) and of varying reaches between underarm rest 18 and handgrip 16 for each person. To this end, with reference to FIGS. 2, 3, 4 and 5, crutch 2 comprises a pair of upper support tubes 12 secured to, and extending from, horizontally extending underarm rest 18, telescoping into a pair of lower support sleeves 14. The telescoping tubes 12 are of an outside diameter 20 corresponding substantially to the inside diameter 22 of the lower pair of support sleeves 14 shown best in FIG. 4 to provide a frictional fit therebetween. The lower pair of parallel support sleeves 14 extend toward the ground converging to provide one support leg 24. To this end support sleeves 14 start to converge (forming a "V" shaped configuration 26) at bends 28 in sleeves 14 until they are joined by rivets 44 and 46. A handgrip is secured between the sleeves 14. With reference to FIG. 4, to assist in the adjustment of the length of the crutch and the positioning of the handgrip with respect to the underarm rest.

When the crutch 2 is to be adjusted, tubes 12 are telescoped a predetermined distance within sleeves 14 or withdrawn a predetermined distance from sleeves 14 until the crutch has been appropriately extended to the required length (held by friction), and the apertures 30 provided in both tubes 12 and sleeves 14 are aligned with one another. Thereafter rod 34 (in the form of a carriage bolt) is pushed through one of the sets of aligned apertures 30 of one sleeve 14 and one tube 12. Thereafter, handgrip 16 is inserted onto rod 34 through bore 36 of handgrip 16. Thereafter, rod 34 is pushed through the aligned apertures through the other sleeve 14 and tube 12, and a wing nut 38 (See FIGS. 4 and 5), is applied to the threaded end of rod 34 to lock the handgrip and the length of the crutch.

Figure 5:
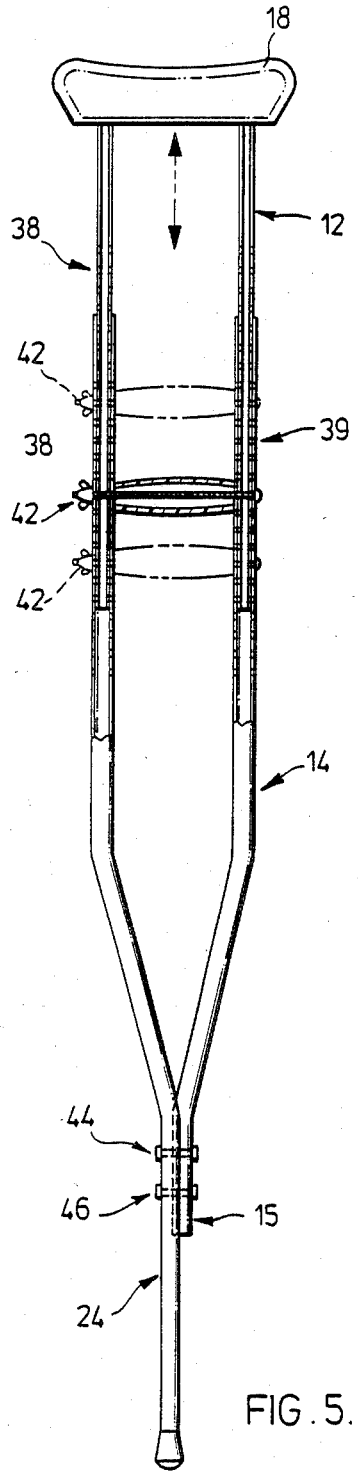
FIG. 5 is a cross-sectional side view of the crutch shown in FIG. 1.

With reference to FIG. 5, handgrip 16 may be secured in any number of positions providing aligned apertures so that with persons of varying height and varying lengths of arms, the crutch is easily adjusted as to the length and "reach" of the arm.

It will be appreciated that adjustable crutch 2 comprising upper support tubes 12 and lower support sleeves 14 telescopical with respect to one another may come in two standard sizes providing two lengths of support tubes 12 and support sleeves 14 sufficient to fit all members of society comprising crutch sizes extending from underarm 4 of man 5 to the ground 6 and from the other underarm 4' to the ground 6 of person 5' of 48–60 inches and 36–48 inches, respectively. Support tubes 12 and support sleeves 14 each carry not more than twelve vertically spaced apertures 30 to ensure that not less than a predetermined segment of support tubes 12 are telescoped within support sleeves 14 sufficient to achieve structural integrity of the crutch.

Figure 6:
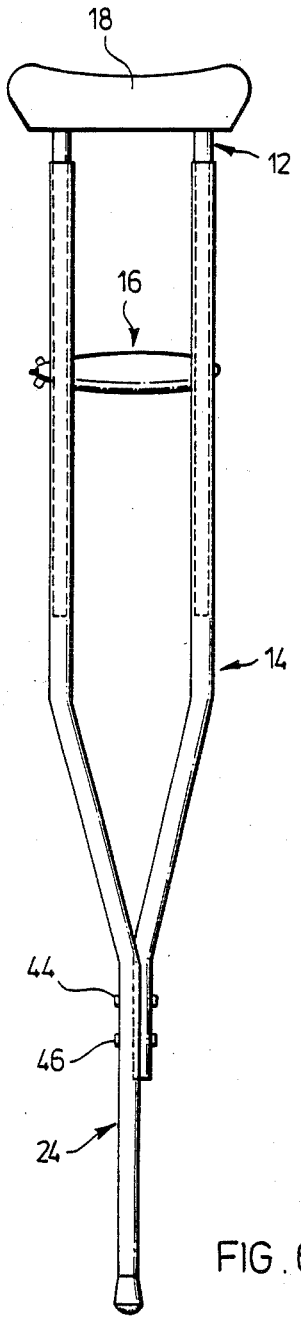
FIG. 6 is a side elevational view of the crutch in the position shown in FIG. 2.

With reference to FIGS. 3, 5 and 6, it is apparent that sleeve members 14 bent at 28 to provide the wishbone shape are secured together by rivets 44 and 46 to provide maximum strength in the securing of the two sleeves 14. One of the sleeves as at 15 has been compressed to cause the outer surface wall to form a channel 15' (See FIG. 3) of a shape to accomodate the outer surface of the other sleeve 14 which extends to the ground forming support leg 24.

As many changes can be made to the embodiment of the invention without departing from the scope of the invention, it is intended that all material be considered illustrative of the invention and not in a limiting sense.

The embodiments of the invention in which an exclusive property or privilege is claimed are as follows:

1. An adjustable crutch generally of the wishbone shape comprising:

(a) a top portion having a pair of spaced vertically extending support members, each support member having two ends, an upper and lower end, said pair of spaced support members being spaced from each other at their upper ends by a horizontally extending underarm rest, the lower end of each support member being spaced from the lower end of the other support member, each support member carrying a plurality of apertures therethrough, aligned with the apertures in the oppositely spaced support member;

(b) a bottom portion having a pair of vertically extending support members, spaced apart at the top of the bottom portion, each support member carrying a plurality of apertures therethrough aligned with the apertures in the oppositely spaced support member, the vertically extending support members converging together towards the bottom to be affixedly joined together in a "Y-shaped" configuration whereby only one of the support members continues down to form the foot of the crutch of the same diameter and material as the one support member, comprising the bottom of the "Y-shaped" configuration;

(c) the top portion and the bottom portion being telescopical with respect to one another so as to permit adjustment of the height of the crutch and permit alignment of the apertures through the support members, and;

(d) a handgrip having means for co-operating with the apertures through the support members whereby the height of the crutch and the position of the handle may be adjusted in a single adjustment of affixedly joining the handgrip between the pair of telescoped members.

* * * * *